US006574803B2

(12) United States Patent
Idone

(10) Patent No.: US 6,574,803 B2
(45) Date of Patent: Jun. 10, 2003

(54) DUAL VOLUME TOILET TANK

(76) Inventor: John Idone, 3303 Prince William Dr., Fairfax, VA (US) 22031

( * ) Notice: Subject to any disclaimer, the term of this patent is extended or adjusted under 35 U.S.C. 154(b) by 83 days.

(21) Appl. No.: 09/822,289

(22) Filed: Apr. 2, 2001

(65) Prior Publication Data

US 2002/0138899 A1 Oct. 3, 2002

(51) Int. Cl.[7] ..... E03D 1/14
(52) U.S. Cl. ..... 4/326
(58) Field of Search ..... 4/326, 324, 327

(56) References Cited

U.S. PATENT DOCUMENTS 4,110,850 A * 9/1978 Tedei ..... 4/326
5,121,510 A * 6/1992 Ricalde-Medin ..... 4/326
5,175,893 A * 1/1993 Navarrete ..... 4/326
5,881,399 A 3/1999 Kartoleksono et al.
5,903,931 A * 5/1999 Kolb, Sr. ..... 4/326

* cited by examiner

*Primary Examiner*—Charles R. Eloshway
(74) *Attorney, Agent, or Firm*—Burns, Doane, Swecker and Mathis, LLP

(57) ABSTRACT

A system is for flushing material, including a tank for containing flushing fluid, and a tube for transporting flushing fluid from the tank, wherein the tube is located in the tank and includes a first opening located at a low volume level and a second opening located directly adjacent to a bottom surface of the tank.

15 Claims, 3 Drawing Sheets

DUAL VOLUME TOILET TANK

BACKGROUND OF THE INVENTION

1. Field of the Invention

The present invention relates generally to flushing devices and more particularly to a system for flushing liquid and solid waste that allows a partial-flush or a full-flush.

2. Background Information

In 1994, as part of the Energy Policy and Conservation Act, Congress banned the sale of toilets that used 3.6 gallons of water to flush, and mandated the use of 1.6 gallon per flush (gpf) or low-flow units. In light of growing water demands, this federal effort seemed like a painless way of reducing water consumption. In fact, some conservationists claim that the smaller tanks can save more than 200 billion gallons of water per year. However, while the present low-flow tank performs well with liquid waste, it falls short when solid waste is to be flushed. This shortcoming not only frustrates users, but also negates any water conservation benefits intended by the Act, as multiple flushes are required to rid the waste.

A system for allowing either a full or partial flush cycle is described in U.S. Pat. No. 5,881,399 (Kartoleksono et al., hereafter referred to as "the Kartoleksono patent"), hereby incorporated by reference in its entirety. The Kartoleksono patent discloses a dual flush mechanism equipped with two independent flush valves that are each separately controllable by a spring loaded button. This system uses a complex, multi-piece tube, which can suffer from leaks at various junction points. Also, the Kartoleksono patent uses a multi-piece, dual-action push button to activate the flush valves, further complicating the design of the system and creating potential mechanical complications. In addition, the two flush valves are positioned in such a way that some residual amount of water will always remain in the toilet tank regardless of which flush mechanism is operated. Such residual water is undesirable as it is likely to become stale and allow the formation of mildew.

Therefore, what is needed is a low-cost and simple system for allowing flush cycles of varying volume, while ensuring that residual water is not left during a full flush.

SUMMARY OF THE INVENTION

Accordingly, the present invention is directed to a system that allows a user to choose between a high volume and a low volume flush, where an entire volume of water contained in a tank is removed during a high volume flush.

According to an exemplary embodiment of the present invention, a system for flushing material is provided, comprising means for containing flushing fluid, and means for transporting flushing fluid from the means for containing, wherein the means for transporting is located in the means for containing and includes a first opening located at a low volume level and a second opening located directly adjacent to a bottom surface of the means for containing.

According to another embodiment of the present invention, a system for flushing material is provided, including a tank for containing flushing fluid, and a tube for transporting flushing fluid from the tank, wherein the tube is located in the tank and includes a first opening located at a low volume level and a second opening located directly adjacent to a bottom surface of the tank.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1:
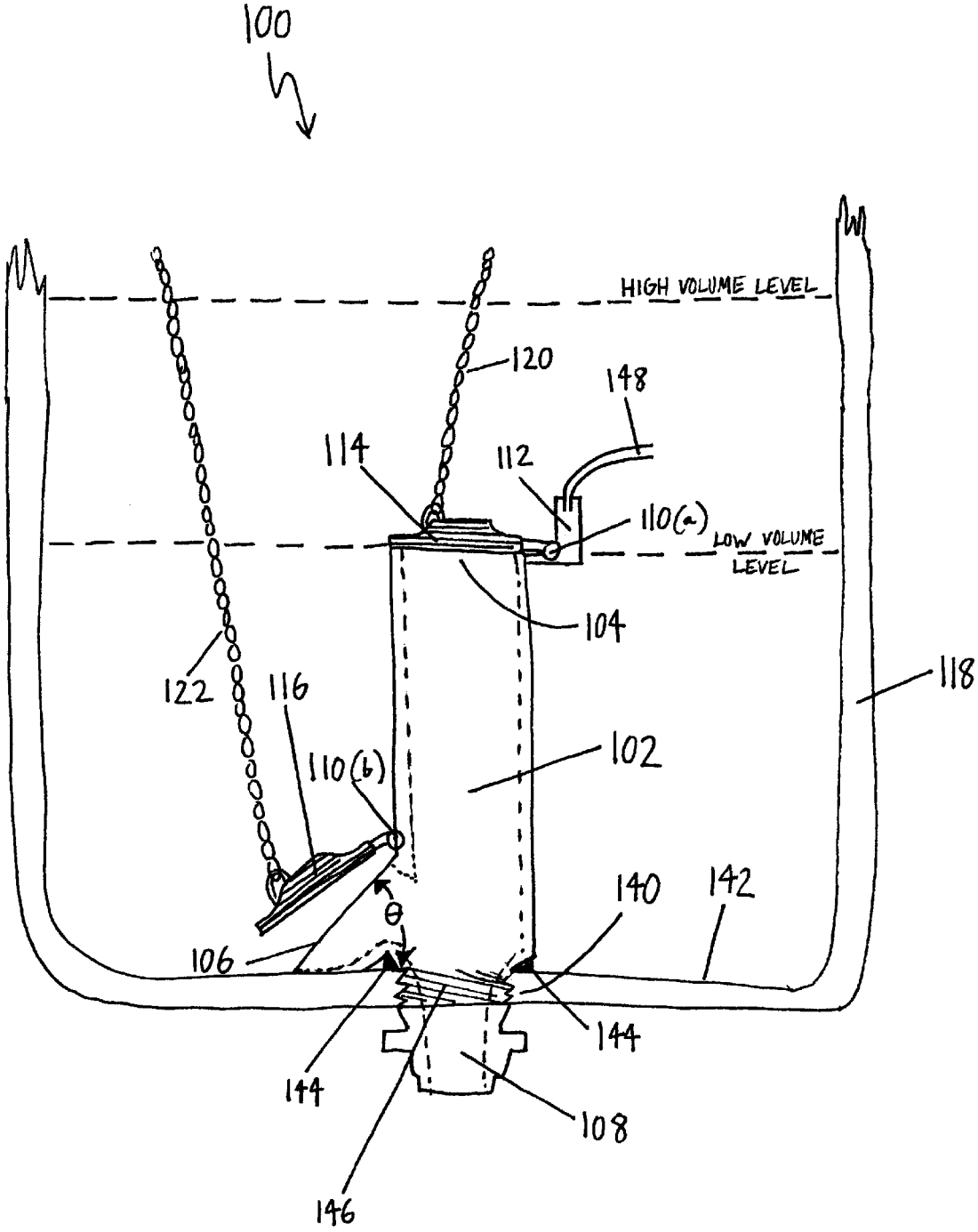
FIG. 1 is a side view of a tank assembly in accordance with an embodiment of the present invention.

FIG. 1 illustrates a system for flushing material, represented by a tank assembly 100. Assembly 100 includes a means for containing flushing fluid, represented by a tank 118, and a means for transporting flushing fluid from the means for containing, represented by tube 102. Tank 118 can be made of a type of ceramic or any other type of material. Also, tank 118 can be of a typical toilet tank shape and standard 3.6 gallon capacity, or can alternatively be of any shape and capacity.

Tube 102 is located in tank 118 and includes a first opening 104 located at a low volume level (LVL) from bottom surface 142 of tank 118 and a second opening 106 located adjacent to surface 142. Tube 102 is a single-piece component and can be manufactured from a type of PVC material or any other material. Of course, tube 102 can, in alternate embodiments, be formed of multiple components. Attached to tube 102 through bottom hole 140 is a lower unit 108 that fits into a lower toilet assembly, which is designed to receive and hold material that is to be flushed away. This material may, for example, be human liquid and/or solid waste, or may be any other type of material. Lower unit 108 may be attached to tube 102 with the use of threads 146 and washers 144, or alternatively by any other conventional or other means. Because only one bottom hole 140 is required to attach tube 102 to a lower unit 108 and a lower toilet assembly, this embodiment of the present invention can easily be retrofitted into existing toilet tanks.

First opening 104 is controlled by a first control assembly and second opening 106 is controlled by a second control assembly. The first control assembly is represented by elements 114 and 120 in FIG. 1, and elements 224, 228, 220, and 214 in FIG. 2. The second control assembly is represented by elements 116 and 122 in FIG. 1, and elements 226, 230, 222, and 216 in FIG. 2. In FIG. 3, elements 324, 328, 334, and 320, and elements 326, 336, 330, and 322 can respectively represent the first and second control assemblies, or can alternatively represent the second and first control assemblies.

Attached to the top of tube 102 is a set of nipples 110(*a*), to which a first flapper valve 114 is hinged. First flapper valve 114 is operated to open and close against first opening 104, thus alternately allowing and preventing the entering of flushing fluid into first opening 104, and consequently tube 102. First flapper valve 114 is moved by first pull chain 120, which is represented as first chain 220 in FIG. 2, where it is shown to be connected to first lever 228 and first handle 224. Also positioned near the top of tube 102 is a receptacle 112 for receiving overflow tube 148.

Near the bottom of tube 102, above bottom opening 106, is attached a set of nipples 110(*b*), to which a second flapper valve 116 is hinged. Second flapper valve 116 is operated to open and close against second opening 106, thus alternately allowing and preventing the entering of flushing fluid into second opening 106, and consequently tube 102. Second flapper valve 116 is moved by second chain 122, which is represented as second chain 222 in FIG. 2, where it is shown to be connected to second lever 230 and second handle 226.

Nipples 110*a* and 110*b* can be included in the fabrication of tube 102, or can be attached to tube 102 after its manufacture. Also, first and second openings 104 and 106, and their respective flapper valves 114 and 116, can be circular or any other shape. Chains 120 and 122 can be of conventional or any other make, and handles 224 and 226 can be manufactured in any shape from any material.

During operation of tank assembly 100, tank 118 is filled with a flushing fluid, which may be water or any other fluid, to a high volume level (HVL). At this level, the volume of flushing fluid contained in tank 118 represents a full flush volume. The volume of flushing fluid contained between the high and low volume levels represents a partial flush volume. For example, the full flush volume can be around the standard 3.6 gallons of flushing fluid, and the partial flush volume can be around the low-flow 1.6 gallons of flushing fluid. In this example, the volume of flushing fluid contained in tank 118 below the low volume level is around 2.0 gallons.

Due to the position of top opening 104 at the low volume level, a user can operate first flapper valve 114 (by using handle 224, for example) to allow a partial flush volume of flushing fluid to exit tank 118 though first opening 104. First opening 104 can be positioned substantially parallel to a top surface of the flushing fluid, or can alternatively be positioned at another angle. Second flapper valve 116 remains, of course, in a closed position over second opening 106 during this partial-flush operation. By operating the first flapper valve 114, the amount of flushing fluid required to flush out material contained in a lower toilet assembly is limited to a partial flush volume. In this way, a user can avoid using a full flush volume to flush out material when the composition of the material does not require such an amount of flushing fluid. An example of such a situation is when the material consists mostly of liquid waste.

When the material includes solid waste, however, a full flush volume of flushing fluid may be necessary to completely flush out the material from the lower toilet assembly. In such a situation, a user can operate second flapper valve 166 (by using handle 226, for example) to allow a full flush volume of flushing fluid to exit tank 118 though second opening 106. First flapper valve 114 remains, of course, in a closed position over first opening 104 during this full-flush operation. Second opening 106 is located directly adjacent to surface 142, such that no step or ledge exists between surface 142 and second opening 106. Such positioning of second opening 106 permits substantially all residual flushing fluid to be drained from tank 118, if desired, after a full-flush operation. As referenced herein, substantially means that virtually all standing fluid can be drained from tank 118.

Second opening 106 can be positioned at an angle θ from surface 142. In an exemplary embodiment, θ is substantially 45 degrees, or lesser or greater. For example, θ can be any angle greater than zero degrees. This positioning allows gravity to aid in closing second flapper valve 106 after a full-flush operation and also helps to ensure that all the flushing fluid contained in tank 118 is transported into tube 102 during a full-flush operation.

Figure 2:
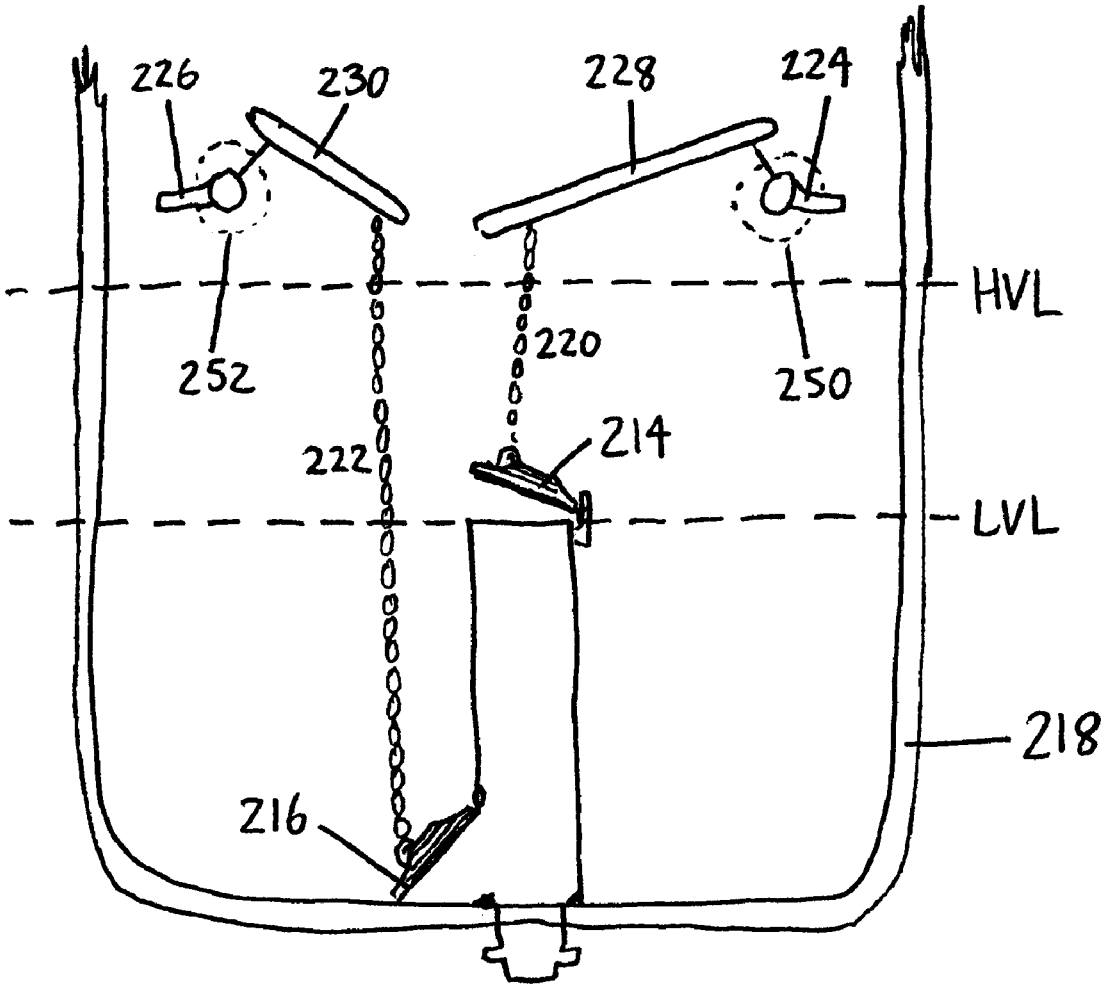
FIG. 2 is a side view of first and second control assemblies in accordance with an embodiment of the present invention.
Figure 3:
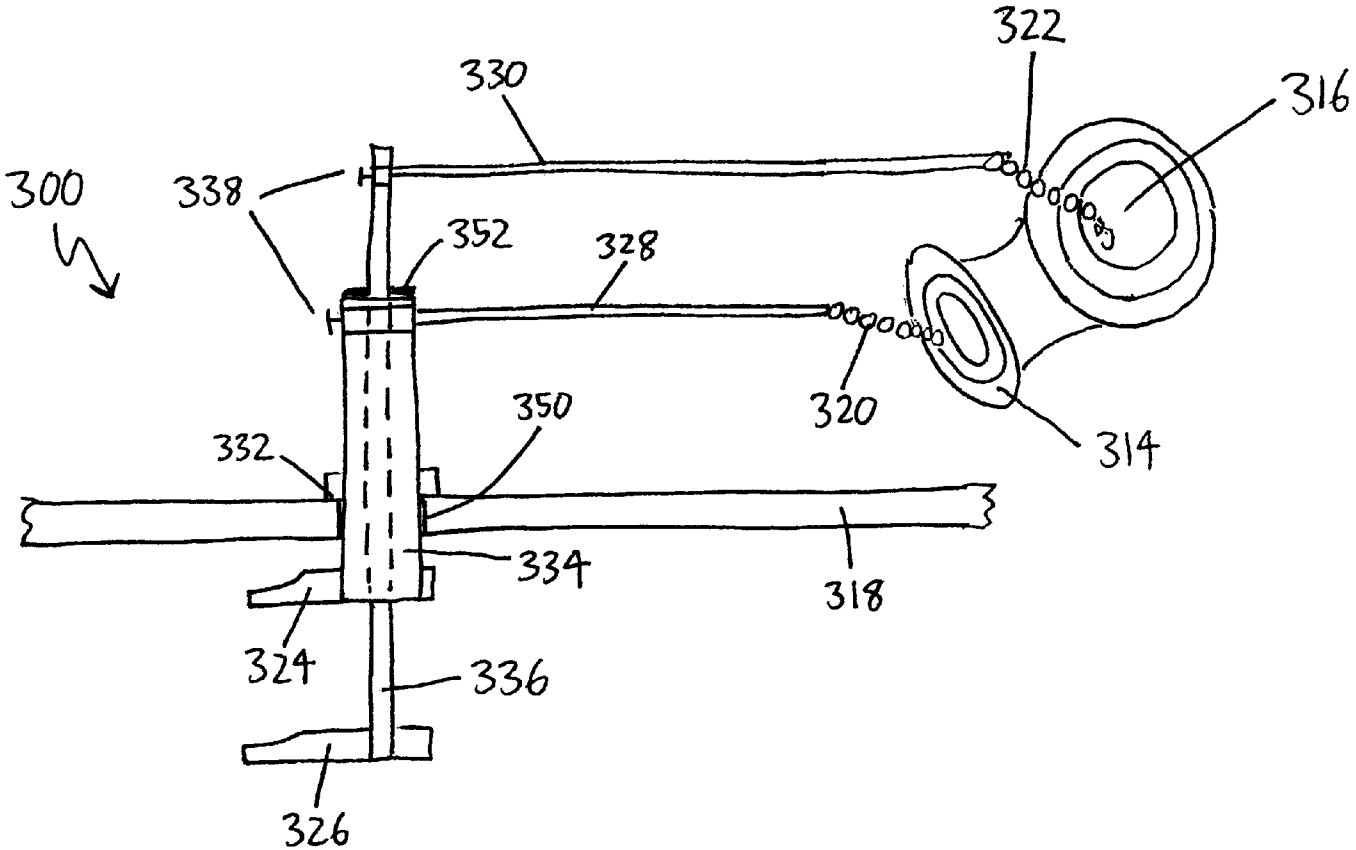
FIG. 3 is a top view of first and second control assemblies in accordance with another embodiment of the present invention.

Different configurations for the first and second control assemblies are illustrated in FIGS. 2 and 3. In the FIG. 2 embodiment, tank 218 includes a first handle opening 250 and a second handle opening 252, which are shown to be located at different ends of a same wall of tank 218. Alternatively, handle openings 250 and 252 can each be located on different walls of tank 218, for example, on opposite or adjacent walls. First handle 224 connects to first lever 228 through opening 250, and second handle 226 connects to second lever 230 through opening 252. Levers 228 and 230 respectively connect to chains 220 and 222, which respectively connect to flapper valves 214 and 216. In this way, a user is able to select a partial flush or a full flush by respectively operating either first handle 224 or second handle 226.

In the FIG. 3 embodiment, tank wall 318 is provided with one handle opening 350, through which a rotatable handle tube 334 connects inner handle 324 and lever 328. Lever 328 can be attached to handle tube 334 with a set screw 338 or any other means, and is connected to flapper valve 314 by chain 320. When inner handle 324 is turned, handle tube 334 rotates, allowing a user to control flapper valve 314. Handle tube 334 can be secured to tank wall 318 with a retaining nut 332, while allowing rotation of handle tube 334, or can alternatively be secured by any other means.

Positioned within handle tube 334 is rotatable rod 336, which extends from both ends of tube handle 334 and connects outer handle 326 to lever 330 by a set screw 338 or any other means. Rod 336 can be secured to handle tube 334, while allowing rotation of rod 336, by a spring washer 352 or any other retaining means. Lever 330 can be attached to rod 336 with a set screw 338 or any other means, and is connected to flapper valve 316 by chain 322. When outer handle 326 is turned, rod 336 rotates, allowing a user to control flapper valve 316. Handle tube 334 and rod 336 may be made of hard plastic or any other non-corrosive material.

In this way, both openings 104 and 106 of tube 102 can be controlled from one location on tank 118, that is, through the single handle opening 350 on tank wall 318. Handles 324 and 326 are positioned at distances from tank wall 318 and from each other such that a user can comfortably operate either one of the handles. Also, the positions of flapper valves 316 and 314 (and the tube openings beneath them) are offset in such a way that levers 330 and 328, and chains 222 and 320 do not be interfere with one another during operation of the tank assembly. Flapper valves 314 and 316 can respectively correspond to first and second openings 104 and 106, or can alternatively correspond to second and first openings 106 and 104, respectively. In other words, a full-flush can be accomplished by operating the inner handle 324 in one embodiment, and with outer handle 326 in another embodiment. Each handle can be marked with an internationally-recognized symbol indicating whether it corresponds to a full-flush or a partial-flush.

The various embodiments of the present invention are low in cost and easy to retrofit into existing toilet assemblies, providing a simple and economical solution to the problems associated with toilets and water conservation.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A system for flushing material, comprising:

means for containing flushing fluid; and means for transporting flushing fluid from the means for containing, wherein the means for transporting is located in the means for containing and includes a first opening located at a low volume level and a second opening located directly adjacent to a bottom surface of the means for containing.

2. The system of claim 1, wherein the second opening is positioned at an angle of substantially 45 degrees from the bottom surface.

3. The system of claim 1, wherein a partial flush volume of the flushing fluid is transported from the means for containing through the first opening, and wherein a full flush volume of the flushing fluid is transported from the means for containing through the second opening.

4. The system of claim 1, wherein the volume in the means for containing between the low volume level and the bottom surface is around 2 gallons.

5. A system for flushing material, comprising:

a tank for containing flushing fluid; and a tube for transporting flushing fluid from the tank, wherein the tube is located in the tank and includes a first opening located at a low volume level and a second opening located directly adjacent to a bottom surface of the tank.

6. The system of claim 5, wherein the second opening is positioned at an angle of substantially 45 degrees from the bottom surface of the tank.

7. The system of claim 5, wherein the first opening is positioned substantially parallel to a top surface of the flushing fluid.

8. The system of claim 5, wherein a partial flush volume of flushing fluid is transported from the tank through the first opening, and wherein a full flush volume of flushing fluid is transported from the tank through the second opening.

9. The system of claim 8, wherein a partial flush volume of flushing fluid is around 1.6 gallons, wherein a full flush volume of flushing fluid is around 3.6 gallons.

10. The system of claim 5, wherein the flushing fluid is water.

11. The system of claim 5, wherein the first opening is controlled by a first control assembly and the second opening is controlled by a second control assembly.

12. The system of claim 11, wherein the first control assembly comprises:

a first handle for operating a first flapper valve, wherein the first handle is attached to the first flapper valve by a first lever and a first chain, and wherein the second control assembly comprises:

a second handle for operating a second flapper valve, wherein the second handle is attached to the second flapper valve by a second lever and a second chain.

13. The system of claim 12, wherein the first flapper valve is operable to alternately allow and prevent the entering of flushing fluid into the first opening, and wherein the second flapper valve is operable to alternately allow and prevent the entering of flushing fluid into the second opening.

14. The system of claim 12, wherein the first handle is connected to the first lever by a tube, and the second handle is connected to the second lever by a rod, and wherein the rod is positioned to rotate within the tube.

15. The system of claim 12, wherein the tank includes a first handle opening and a second handle opening, wherein the first handle is connected to the first lever through the first handle opening, and wherein the second handle is connected to the second lever through the second handle opening.

* * * * *